United States Patent [19]

Marshall

[11] Patent Number: 5,070,438

[45] Date of Patent: Dec. 3, 1991

[54] PEN-SIZE FLASHLIGHT

[75] Inventor: Francis G. Marshall, Meriden, Conn.

[73] Assignee: The Bridgeport Metal Goods Mfg. Co., Bridgeport, Conn.

[21] Appl. No.: 496,682

[22] Filed: Mar. 21, 1990

[51] Int. Cl.[5] ..... F21L 7/00

[52] U.S. Cl. ..... 362/206; 362/118; 362/202; 200/60

[58] Field of Search ..... 362/109, 118, 157, 202, 362/205, 206, 204, 208; 200/60

[56] References Cited

U.S. PATENT DOCUMENTS

| | | | |
|---|---|---|---|
| 2,225,936 | 12/1940 | Williams | 362/206 |
| 3,604,917 | 9/1971 | Schmidt | 362/118 |
| 4,286,311 | 8/1981 | Maglica | 362/205 |
| 4,388,673 | 6/1983 | Maglica | 362/183 |
| 4,517,628 | 5/1985 | McDermott | 362/202 |
| 4,527,223 | 7/1985 | Maglica | 362/187 |
| 4,577,263 | 3/1886 | Maglica | 362/187 |
| 4,656,565 | 4/1987 | Maglica | 362/187 |
| 4,658,336 | 4/1987 | Maglica | 362/197 |
| 4,725,932 | 2/1988 | Gammache | 362/202 |
| 4,819,141 | 4/1989 | Maglica et al. | 362/207 |
| 4,823,242 | 4/1989 | Maglica et al. | 362/187 |
| 4,841,417 | 6/1989 | Maglica et al. | 362/187 |
| 4,851,974 | 7/1989 | Maglica | 362/187 |
| 4,864,474 | 9/1989 | Maglica | 362/203 |
| 4,888,670 | 12/1989 | Sharrah | 362/202 |
| 4,905,129 | 2/1990 | Sharrah | 362/206 |
| 4,907,134 | 3/1990 | Tarrson et al. | 362/206 |
| 4,951,183 | 8/1990 | Wang | 362/187 |

*Primary Examiner*—Ira S. Lazarus
*Assistant Examiner*—D. M. Cox
*Attorney, Agent, or Firm*—Parmelee, Bollinger & Bramblett

[57] ABSTRACT

A pen-size flashlight comprises a tubular body receiving two size AAAA batteries and having a bulb and bulb contact assembly mounted on the forward end and a switch assembly driven by a rotatable cap on the rear end. The bulb contact assembly is removable for changing batteries and includes a bulb holder threadably secured to the tubular body and mounting a bulb, an insulator mounted to the bulb holder and defining an opening extending from the bulb tip terminal toward the front battery terminal and a dual diameter coil spring extending through the insulator to electrically connect the bulb tip terminal and the front battery terminal. The switch assembly includes a switch housing defining a threaded opening extending rearwardly from the rear battery terminal and a switch plunger threadably received in the switch housing opening. A switch driver sleeve is mounted for rotation about the switch housing and a cap is fitted over the switch driver sleeve and switch assembly. The switch driver sleeve engages the switch plunger such that rotation of the cap relative to the tubular body rotates the switch plunger in and out of contact with the rear battery terminal to turn the flashlight ON and OFF. The switch driver sleeve accommodates axial movement of the switch plunger without imparting that axial movement to the cap.

32 Claims, 4 Drawing Sheets

Fig. 2.
| | | |
|---|---|---|
| FIG. 2A. | FIG. 2B. | FIG. 2C. |
Fig. 2C.
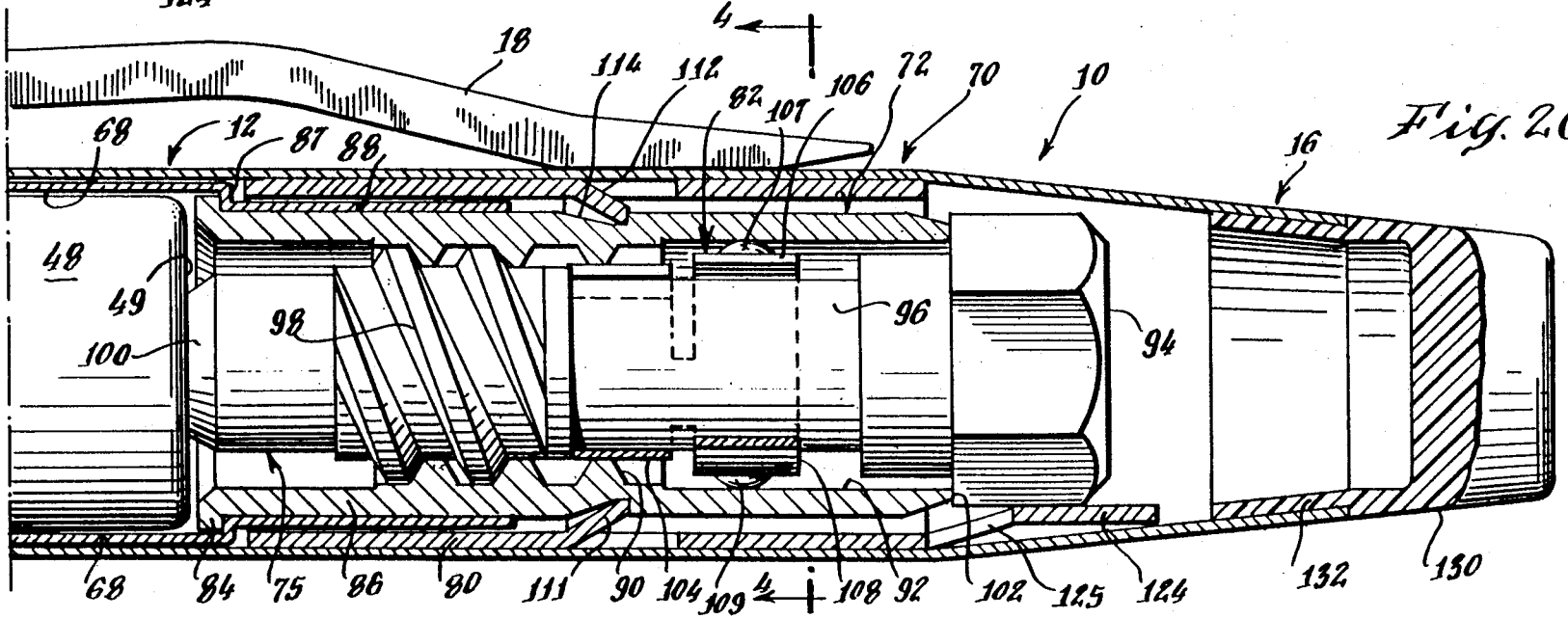
Fig. 5.
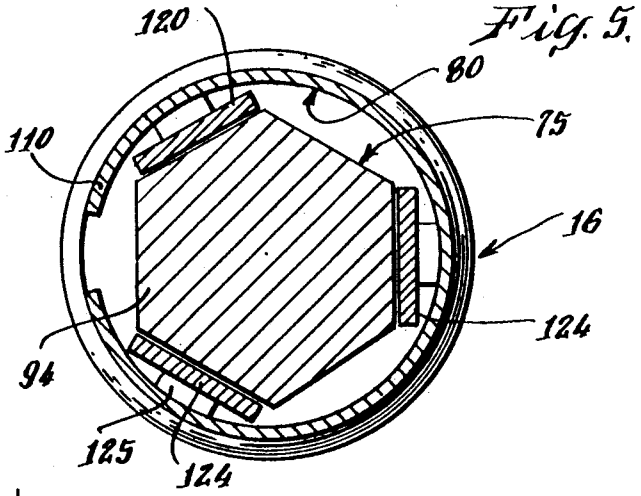

PEN-SIZE FLASHLIGHT

FIELD OF INVENTION

The invention herein relates to a small, pen-size flashlight. It further relates to a small pen-size flashlight that is switched by rotation of a cap relative to a tubular body of the flashlight.

BACKGROUND OF INVENTION

A small flashlight is handy to have. It can be useful in numerous ways, such as locating and selecting a proper key at night, locating objects which have been dropped in places which are dimly lit or not lit at all and in many other ways. Desired features in a small light are portability, ease of operation, dependability and a neat, clean and functional appearance. The size of a pen is ideal, adapting the flashlight to be carried in a pocket or purse.

It is difficult to achieve the foregoing features in a flashlight of pen size. For instance, traditional flashlights often have a switch on the side of the tubular body, but such a switch would increase the size of a small flashlight beyond that of a pen. A pushbutton switch creates the possibility of accidentally operating the light in a purse or pocket, such that the batteries would be dead when the flashlight was needed.

SUMMARY OF INVENTION

Accordingly, it is a principal object of the invention herein to provide a pen-size flashlight.

It is a further object of the invention herein to provide a pen-sized flashlight which has a reliable switching mechanism.

It is an additional object of the invention to provide a pen-sized flashlight which is small and attractive, but which is nevertheless of sturdy, construction for dependable operation.

A flashlight according to the invention herein is pen-sized and is switched by rotating a cap relative to a tubular body of the flashlight. The forward portion of the tubular body mounts a bulb in a bulb contact assembly. The bulb contact assembly is removable for inserting batteries in the tubular body, and a conductive coil spring, insulated from the tubular body, is positioned between the tip terminal of the bulb and the front battery terminal. The coil spring includes one or more larger diameter center coils for positioning the coil spring in an insulating holder, and the spring seats the bulb in its holder contact and also compensates for variation in battery size. The rear battery is supported and positioned on a stop within the tubular body.

The switching mechanism of the flashlight includes a rotatable cap extending coaxially rearwardly from the tubular body. The cap rotates a switch plunger, which is slideably free for axial movement with respect to the cap and tubular body. This is preferably achieved by providing an interior switch driver sleeve fitted inside the cap, the switch driver sleeve both mounting the cap for rotation with respect to the tubular body and receiving the switch plunger for rotation with the cap and sliding axial movement with respect to the cap.

The switch plunger is threadably received in the tubular body, behind the battery such that rotation of the cap drives the switch plunger into or out of contact with the rear battery terminal. A switch housing is preferably fitted into the rear of the tubular body to threadably receive the switch plunger and also to support the rear of the batteries, as discussed above. Electrical contact is established between the switch plunger and the bulb base, preferably through the use of the conductive parts for the switch housing, tubular body and bulb contact assembly. A switch contact wiper is advantageously provided between the switch plunger and the switch housing, to insure continuous electrical contact and to provide spring bias between the switch plunger and switch housing.

The switch plunger and switch housing have high-pitched mating threads for substantial travel by minimum rotation. Axial travel of the switch plunger is advantageously limited by stops, with a preferred 270° maximum rotation between the ON and OFF position. The "ON" stop is provided by the switch housing itself, and the rear stop is provided by interference between the switch plunger and the cap. A clip is provided on the cap, to facilitate carrying the flashlight in a pocket.

Further objects and features of the invention herein will be recognized with reference to the following description of the preferred embodiment, taken together with the drawings.

DRAWINGS

FIG. 2 illustrates the manner in which FIGS. 2A, 2B and 2C may be connected to show a sectional view, partially cut away, of the flashlight;

FIG. 2C is a longitudinal, sectional view of the rear, portion of the flashlight including the switch assembly in its ON position;

FIG. 5 is cross-sectional view of the flashlight taken along the lines 5—5 of FIG. 3, showing the relationship between a switch plunger and a switch driver sleeve.

The same reference numerals refer to the same elements throughout the various Figures.

DESCRIPTION OF PREFERRED EMBODIMENT

Figure 1:
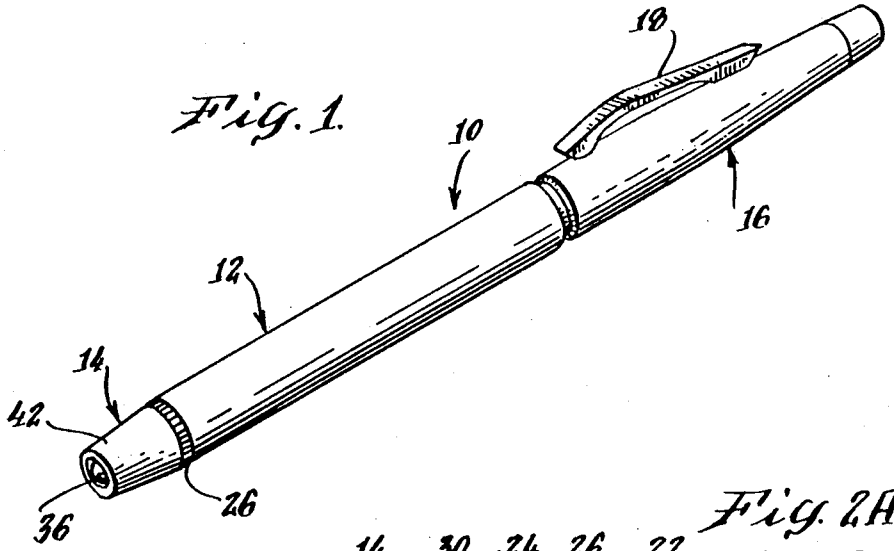
FIG. 1 is a perspective view of a pen-sized flashlight according to the invention herein.

With reference to FIG. 1, there is shown a pen-sized flashlight 10 according to the invention herein. The flashlight 10 generally comprises a tubular body 12 having a bulb 36 mounted in a bulb contact assembly 14 at the forward end of the tubular body 12, and a cap 16 mounted over the rear of the tubular body 12. Rotation of the cap 16 relative to the tubular body 12 operates a switch mechanism to turn the flashlight ON and OFF.

The flashlight 10 is approximately the same size as a pen, whereby it may be easily carried in a purse or a pocket. A clip 18 is provided for the latter purpose.

Throughout this written description and the following claims, the terms "forward," "front" and similar terms refer to the end of flashlight 10 where the bulb is mounted, and the terms "rearward," "rear" and the like refer to the opposite end where the cap is mounted.

Figure 2A:
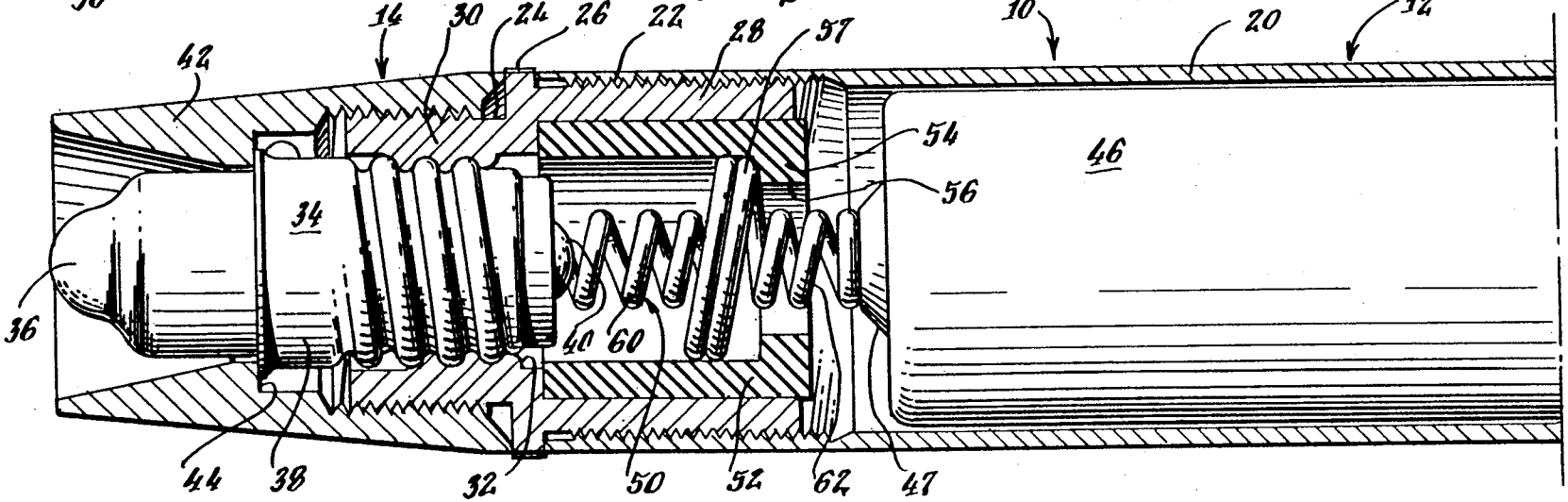
FIG. 2A is a longitudinal sectional view of the front portion of the flashlight including the bulb contact assembly.

The forward portion of the flashlight 10 including the bulb contact assembly 14 is shown in more detail in FIG. 2A. The tubular body 12 first comprises a cylindrical outer body tube 20, which is interiorly threaded at 22, adjacent its forward end. The bulb contact assembly 14 comprises a bulb holder 24, which includes an annular ring 26 having a threaded cylindrical skirt 28 extending rearwardly therefrom, the threaded skirt 28 being received in the outer body tube 20 to removably mount the bulb contact assembly 14 thereon.

Extending forwardly of the annular ring 26 is a bulb mount skirt 30 which defines threads 32 on its interior surface for threadably receiving the base 34 of a bulb 36. The bulb 36 is preferably a "miniature 222 bulb" and the forward portion 38 of the glass envelope is formed as a lens to disperse the light produced by the bulb. The base 34 constitutes one terminal of the bulb, and the bulb is further provided with a tip terminal 40 mounted on insulator 38. The exterior of the bulb mount skirt 30 is also threaded, and threadably receives a bulb protector 42 that surrounds and protects the bulb 38. Additionally, the bulb protector 42 has a shoulder 44 engaging the base 34 of the bulb and stabilizing and holding the bulb 36 in position.

The bulb holder 24 is conductive and electrically connects the bulb base 34 with the outer body tube 20, which is also preferably conductive. Alternatively, a contact strip may lie along the inside of the tubular body 12, connecting the bulb holder 24 with the switch assembly discussed below. The tubular body 12 also receives batteries 46 and 48 which are inserted by removing the bulb contact assembly 14. The ring 26 is knurled on its outside surface to aid in this process.

The forward terminal 47 of the battery 46 is electrically connected to the bulb tip terminal 40 by a dual diameter coil spring 50, which is received in an insulator 52. More particularly, the insulator 52 is generally cylindrical and is fitted inside the skirt 28, and includes a flange 54 defining an opening 56 at its rear end. The dual diameter coil spring 50 includes large diameter central coils 58 which engage with the flange 54 and hold and axially position the coil spring within the insulator 52. A smaller diameter forward coil portion 60 extends forwardly to engage the bulb tip terminal 40, and an additional smaller diameter coil portion 62 extends rearwardly through the opening 56 to engage the terminal 47 of battery 46. The dual diameter coil spring 50 thereby biases the bulb forwardly in its threads and firms up its mechanical mounting and electrical connection with the threads. The coil spring 50 also accommodates variations in the battery length due to battery manufacturing tolerances and differences, as illustrated in FIG. 3 wherein the maximum battery length brings the battery near to or touching the insulator 52, with the terminal 47 extending into opening 56.

Figure 2B:
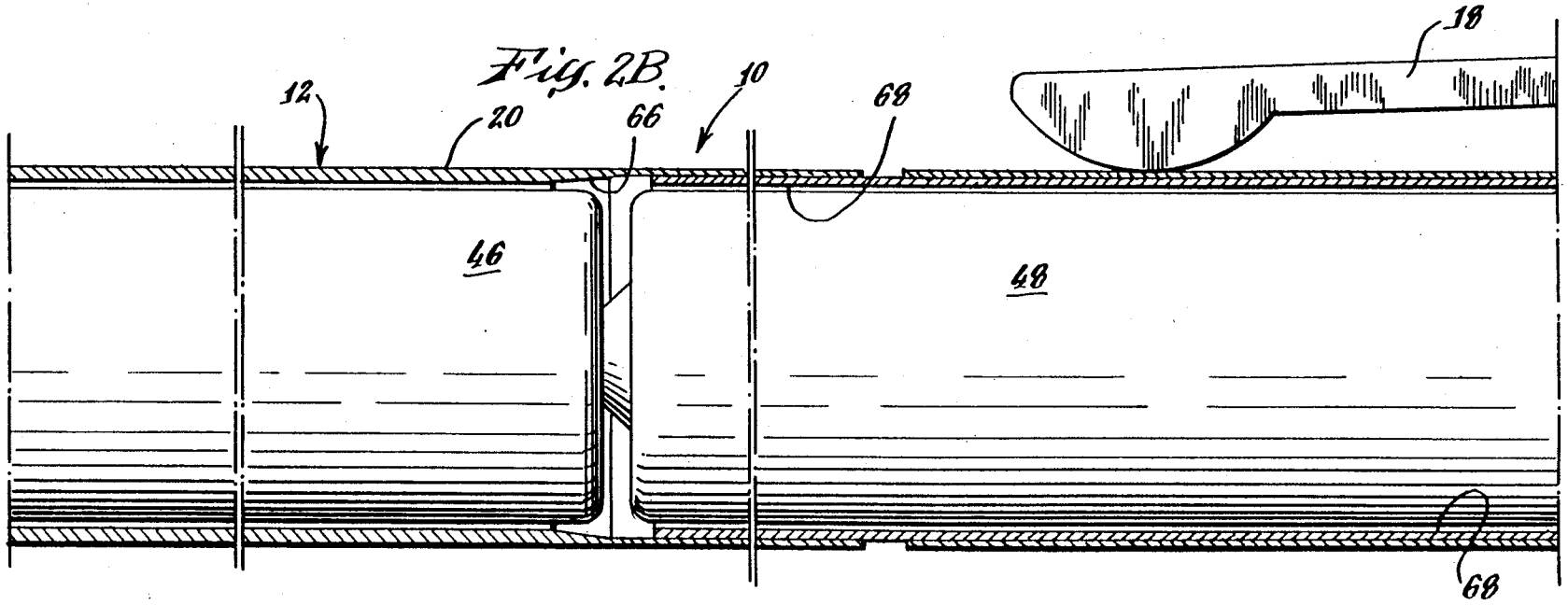
FIG. 2B is a longitudinal sectional view, partially cut-away, of the central portion of the flashlight.
Figure 9:
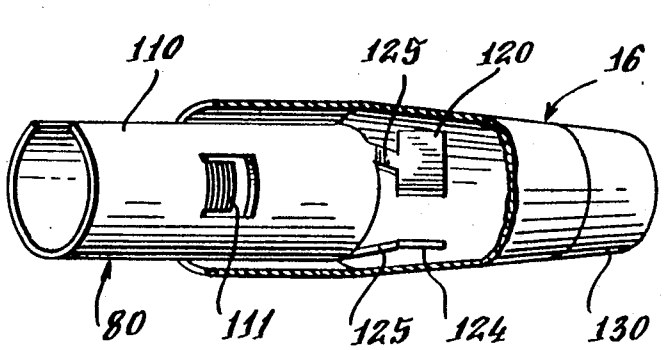
FIG. 9 is a perspective view of the switch contact wiper of the flashlight.

The tubular body 12 first comprises the outer body tube 20, which mounts the bulb contact assembly 14 as discussed above. The outer body tube extends rearwardly, having an inside diameter which accommodates size AAAA batteries for the flashlight 10. With reference to FIG. 2B, the outer body tube 20 tapers at 66 to a larger inside diameter. An inner body tube 68 is pressfit into the larger inside diameter portion of the outer body tube 20 and the inner body tube 68 extends rearwardly to a switch assembly 70.

Figure 4:
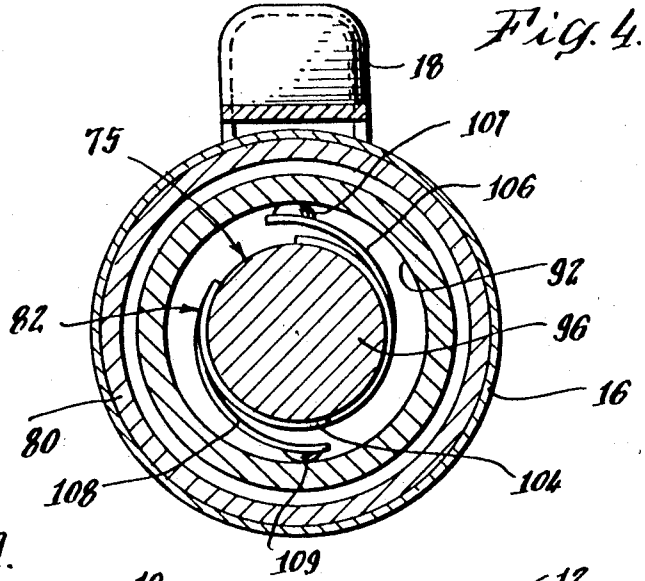
FIG. 4 is a cross-sectional view of the flashlight taken along the lines 4—4 of FIG. 2C, and showing a switch contact wiper.
Figure 3:
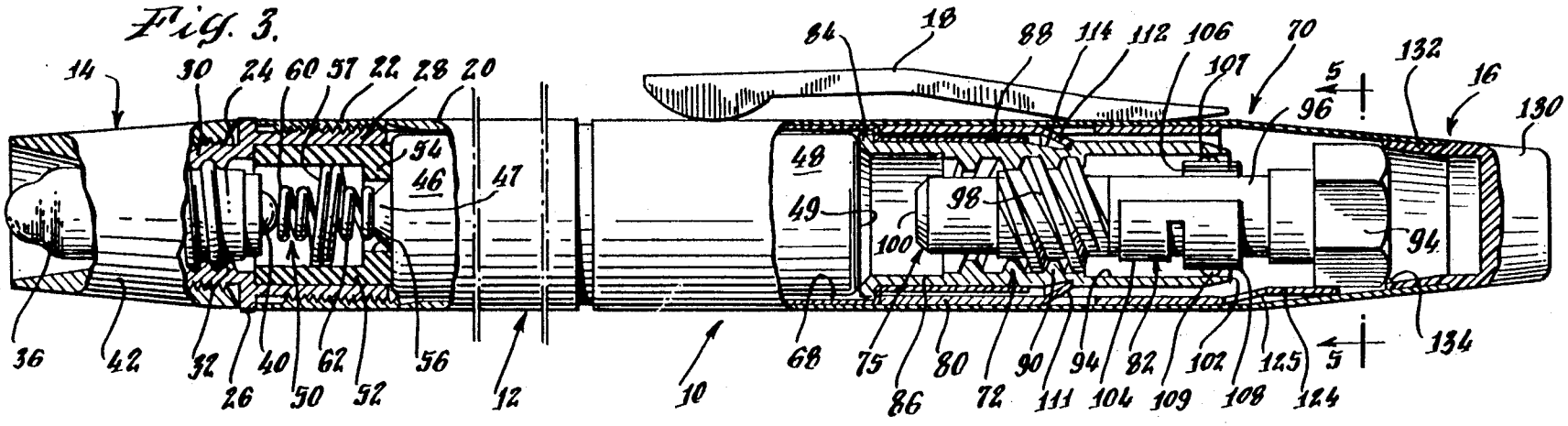
FIG. 3 is a side elevation view, partially cut away and partially in section, of the flashlight of FIG. 1, with the switch assembly in its OFF position.
Figure 6:
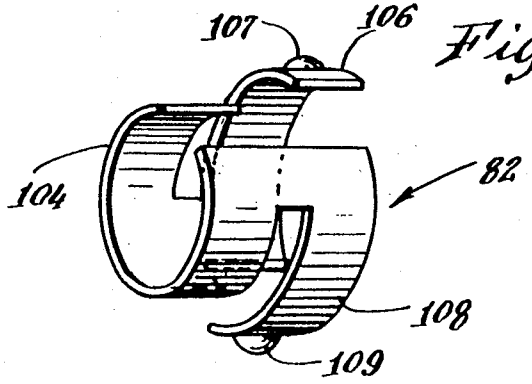
FIG. 6 is an exploded perspective view of elements of the switch assembly of the flashlight.
Figure 8:
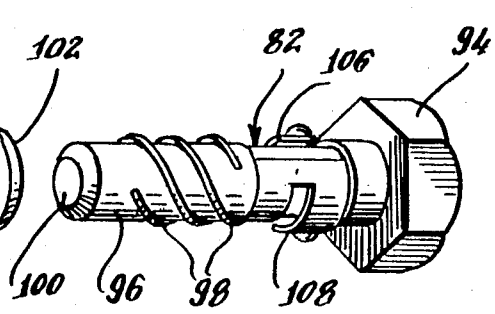
FIG. 8 is an end elevation view of the switch contact wiper of the flashlight.
Figure 7:
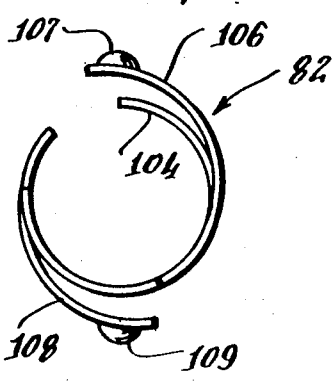
FIG. 7 is a side elevation view of the switch contact wiper of the flashlight.
Figure 7:
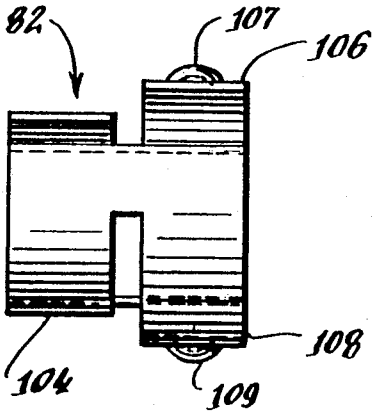

The switch assembly 70 is best seen in FIGS. 2C, 3 and 6, as well as in the two sectional FIGS. 4 and 5. The switch assembly 70 generally comprises a switch housing 72 and a switch plunger 75 threadably mounted therein for axial movement in and out of contact with the rear terminal of battery 48. The switch plunger 75 is rotated by a switch driver sleeve 80, which fits inside and is rotated by the cap 16. A switch contact wiper 82 is provided to insure electrical contact and smooth operation of the assembly.

More particularly, the switch housing 72 is generally cylindrical, and has a flange 84 at its forward end with a tubular housing portion 86 extending rearwardly therefrom. The inner body tube 68 is necked down at 87 to a further reduced diameter portion 88 which receives the switch housing 72 in pressfit relationship. The flange 84 supports the rear of battery 48, and the rear battery case terminal 49 is presented to the switch housing 72.

The inside of the tubular housing 86 defines high pitch threads 90. The interior of the housing aft of the threads 90 is smooth, as indicated at 92. The switch plunger 75 comprises a hexagonal head 94 and a shank 96, having high pitch threads 98 formed toward the forward distal end 100. The threads 98 are complementary with the threads 90 of the switch housing 72, whereby clockwise rotation of the switch plunger 75 axially translates the distal end 100 into contact with the rear case terminal 49 of battery 48. Forward travel of the switch plunger is limited by the head 94 abutting against the rear of the switch housing 72, as indicated at 102 in FIG. 2C. and the distal end 100 may lift the battery 48 slightly away from flange 84 of the switch plunger 72, thereby insuring contact.

The switch plunger 75, switch housing 72 and the inner and outer body tubes 62, 20 comprising the tubular body 12 are all electrically conductive, whereby a circuit is established through the bulb holder 24 to the bulb base 34, and from the bulb tip terminal 40 through the coil spring 50 to the front battery terminal 47. Thus, with the switch assembly 70 in the position shown in FIG. 2C, the flashlight 10 is ON. Of course, rotating the switch plunger counterclockwise to open the contact between the distal end 100 of the switch plunger and the rear battery case terminal turns the flashlight OFF, as shown in FIG. 3.

The preferred embodiment of flashlight 10 further includes the switch contact wiper 82, also seen in the sectional view of FIG. 4 and in FIGS. 6–9. The switch contact wiper has a cylindrical split ring 104, which fits around and grips the shank 106 of the switch plunger 75. The switch contact wiper further comprises outwardly spiralling wings 106 and 108, respectively provided with raised dimples 107 and 109, wherein the raised dimples are biased against the smooth interior 92 of the switch housing 72. This not only assures good electrical conductivity, but also serves to provide support for the switch plunger and friction against rotation for good feel in operation of the switching mechanism.

Rotation of the switch plunger is achieved by the switch driver sleeve 80 and the cap 16. The switch driver sleeve 80 has a first split tubular portion 110 which is pressfit inside the cap 16 and loosely surrounds the rear portion 88 of the inner body tube 68 and the protruding portion of the switch housing 72. The switch driver sleeve has two inwardly angled barbs 111 and 112 which are received in a peripheral groove 114 defined about the exterior of the switch housing 72. The engagement of the barbs 111, 112 in groove 114 together with the proximity of the forward end of the switch driver sleeve with the change in diameter of the inner body tube 88, axially position the cap 16 and switch driver sleeve and secure them to the tubular body 12, while permitting rotation of the cap and switch driver sleeve.

The switch driver sleeve further comprises three driver panels 120, 122 and 124, which extend rearwardly from the split cylindrical sleeve 110 on struts, such as strut 125 seen in FIG. 2C. With reference to FIG. 5, the driver panels 120, 122 and 124 respectively embrace alternating faces of the hexagonal head 94 of the switch plunger 75, and are restrained within the cap 16. Thus, rotation of the cap 16 with respect to the tubular body 12 rotates the switch plunger 75 via the driver panels, but the driver panels permit the switch plunger to move axially in and out of contact with the rear battery terminal 49.

The cap 16 preferably extends, at its forward end, to near the rearward termination of the outer body tube 20. The clip 18 swaged to the cap 16, as best seen in FIG. 2C. It will be appreciated that the flashlight 10 is illustrative of the invention herein and that various changes and modifications may be made without departing from the spirit and scope of the invention, which is limited only by the following claims and equivalent elements thereof. The rear of the cap tapers and is finished by a finial 130. The finial 130 is mounted by means of a skirt 132 swaged inside the cap, and the skirt serves an additional purpose of stopping rearward movement of the switch plunger by interference with the hex head 94, as illustrated at 134 in FIG. 3. In the preferred embodiment shown, rotation of the cap through an arc of 270° produces axial motion of the switch plunger from its ON position to its rearward stopped position against the skirt 132.

It will be appreciated that if it is desired to construct the tubular body of non-conducting materials, it is necessary to provide a contact strip between the switch housing and the bulb contact assembly 14.

The flashlight 10 described above is characterized by small size, generally equivalent to a pen, with smooth and reliable operation. It will be appreciated that the flashlight 10 is illustrative of the invention herein and that various changes and modifications may be made without departing from the spirit and scope of the invention, which is limited only by the following claims and equivalent elements thereof.

What is claimed:

1. A flashlight comprising:

A. a tubular body receiving therein at least one cylindrical battery of the type having a front terminal and a rear terminal;

B. a bulb and bulb contact assembly mounted at the forward end of the tubular body and being removable for changing batteries, the bulb contact assembly including 1. a bulb holder threadably secured to the tubular body, the bulb holder mounting the base terminal of the bulb therein,
2. an insulator mounted to the bulb holder and defining an opening extending from a tip terminal of the bulb toward the front terminal of the battery, and
3. a conductive coil spring extending through the insulator opening between the bulb tip terminal and the front battery terminal;

C. a switch assembly mounted at the rearward end of the tubular body, the switch assembly including 1. a switch housing mounted to the tubular body and defining a threaded opening extending rearwardly from the rear battery terminal, and
2. a switch plunger threadably received in the switch housing opening wherein rotation of the switch plunger moves it axially selectively into and out of contact with the rear battery terminal, the switch plunger being electrically connected to the base terminal of the bulb, whereby the flashlight is ON when the switch plunger is in contact with the rear battery terminal; and D. a cap extending rearwardly from the tubular body and surrounding the switch assembly, the cap being connected with the switch plunger such that rotation of the cap relative to the tubular body rotates the switch plunger to turn the flashlight ON and OFF.

2. A flashlight as defined in claim 1 wherein the bulb contact assembly further includes a bulb protector threadably mounted on the bulb holder and extending forwardly therefrom to surround and protect the bulb, the bulb protector being removable to change the bulb.

3. A flashlight as defined in claim 1 wherein the coil spring of the bulb contact assembly is a dual diameter coil spring having at least one larger diameter coil supported in the insulator opening, a smaller diameter coil portion extending forwardedly to contact the bulb tip terminal and another smaller diameter coil portion extending rearwardly to contact the front battery terminal.

4. A flashlight as defined in claim 3 wherein the insulator of the bulb contact assembly has a flange which confines the at least one larger diameter coil within the insulator opening to retain the coil spring as a part of the bulb contact assembly.

5. A flashlight as defined in claim 1 wherein the tubular body accepts two axially aligned size AAAA batteries.

6. A flashlight as defined in claim 1 wherein the bulb holder, tubular body and switch housing are electrically conductive for establishing a conductive path from the switch plunger to the bulb base terminal.

7. A flashlight as defined in claim 6 wherein the switch assembly further includes a switch contact wiper, the switch contact wiper comprising at least one resilient metal strip secured to the switch plunger and extending outwardly into biased electrical contact with the switch housing, the switch contact wiper providing a conductive path from the switch plunger to the switch housing and providing frictional resistance against rotation of the switch plunger in the switch housing.

8. A flashlight as defined in claim 7 wherein the switch contact wiper includes a split ring surrounding and gripping the switch plunger and two wiper wings extending spirally outwardly into contact with the switch housing.

9. A flashlight as defined in claim 1 wherein the switch assembly further includes a switch contact wiper, the switch contact wiper comprising at least one resilient metal strip secured to the switch plunger and extending outwardly into biased electrical contact with the switch housing, the switch contact wiper providing a conductive path from the switch plunger to the switch housing and providing frictional resistance against rotation of the switch plunger in the switch housing, and wherein the switch housing is electrically connected to the bulb base terminal.

10. A flashlight as defined in claim 1 wherein the switch assembly further includes a switch driver sleeve, the switch driver sleeve being mounted for rotation about the switch housing and the cap being mounted on the switch driver sleeve for rotation therewith, the switch driver sleeve engaging the switch plunger for imparting rotational movement of the cap to the switch plunger without imparting axial movement of the switch plunger to the switch driver sleeve and cap.

11. A flashlight as defined in claim 10 wherein the switch driver sleeve includes at least two radially inwardly depending tabs received in an annular groove about the switch housing, thereby mounting the switch driver sleeve and cap for rotational movement with respect to the tubular body.

12. A flashlight as defined in claim 10 wherein the switch plunger has a polygonal head and the switch driver sleeve includes panels engaging at least two faces of the polygonal head to impart rotational movement of the switch driver sleeve to the switch plunger while accommodating axial movement of the switch plunger head along the panels.

13. A flashlight as defined in claim 12 wherein the polygonal head of the switch plunger engages the rear of the switch housing to limit forward motion of the switch plunger an increment beyond contact with the rear battery terminal.

14. A flashlight as defined in claim 13 wherein the polyganol head of the switch plunger interferes with the cap to limit rearward movement of the switch plunger.

15. A flashlight as defined in claim 14 wherein the cap has a finial at its rearward end, the finial including a skirt extending into the interior of the cap to mount the finial thereto, and the polygonal head of the switch plunger interferes with the finial skirt to limit rearward movement of the switch plunger.

16. A flashlight as defined in claim 14 wherein the cap rotates less than 360° between the stop positions of the switch plunger.

17. A flashlight comprising:

A. a tubular body receiving therein at least one cylindrical battery of the type having a front terminal and a rear terminal;

B. a bulb and bulb contact assembly mounted at the forward end of the tubular body and being removable for changing batteries, the bulb contact assembly including 1. a bulb holder threadably secured to the tubular body, the bulb holder mounting the base terminal of the bulb therein,
2. an insulator mounted to the bulb holder and defining an opening extending from a tip terminal of the bulb toward the front terminal of the battery, and
3. a conductive coil spring extending through the insulator opening between the bulb tip terminal and the front battery terminal;

C. a switch assembly mounted at the rearward end of the tubular body, the switch assembly including means for selectively establishing electrical contact between the rear battery terminal and the bulb base terminal; and D. a cap extending rearwardly from the tubular body and surrounding the switch assembly, the cap being manipulable to operate the switch mechanism to turn the flashlight ON and OFF.

18. A flashlight as defined in claim 17 wherein the bulb contact assembly further includes a bulb protector threadably mounted on the bulb holder and extending forwardly therefrom to surround and protect the bulb, the bulb protector being removable to change the bulb.

19. A flashlight as defined in claim 17 wherein the coil spring of the bulb contact assembly is a dual diameter coil spring having at least one larger diameter coil supported in the insulator opening, a smaller diameter coil portion extending forwardedly to contact the bulb tip terminal and another smaller diameter coil portion extending rearwardly to contact the front battery terminal.

20. A flashlight as defined in claim 19 wherein the insulator of the bulb contact assembly has a flange which confines the at least one larger diameter coil within the insulator opening to retain the coil spring as a part of the bulb contact assembly.

21. A flashlight comprising:

A. a tubular body receiving therein at least one cylindrical battery of the type having a front terminal and a rear terminal;

B. a bulb mounted at the forward end of the tubular body with the tip terminal of the bulb in contact with the front terminal of the battery;

C. a switch assembly mounted at the rearward end of the tubular body, the switch assembly including:

1. a switch housing mounted to the tubular body and defining a threaded opening extending rearwardly from the rear battery terminal, and
2. a switch plunger threadably received in the switch housing opening wherein rotation of the switch plunger moves it axially selectively into and out of contact with the rear battery terminal, the switch plunger being electrically connected to the base terminal of the bulb, whereby the flashlight in ON when the switch plunger is in contact with the rear battery terminal; and D. a cap extending rearwardly from the tubular body and surrounding and enclosing the switch assembly, the cap being connected for rotational and relative axial movement with the switch plunger such that rotation of the cap relative to the tubular body rotates the switch plunger to turn the flashlight ON and OFF, without imparting the axial movement of the switch plunger to the cap.

22. A flashlight as defined in claim 21 wherein the tubular body is electrically conductive for establishing a conductive path from the switch plunger to the bulb base terminal.

23. A flashlight as defined in claim 22 wherein the switch assembly further includes a switch contact wiper, the switch contact wiper comprising at least one resilient metal strip secured to the switch plunger and extending outwardly into biased electrical contact with the switch housing, the switch contact wiper providing a conductive path from the switch plunger to the switch housing and providing frictional resistance against rotation of the switch plunger in the switch housing.

24. A flashlight as defined in claim 23 wherein the switch contact wiper includes a split ring surrounding and gripping the switch plunger and two wiper wings extending spirally outwardly into contact with the switch housing.

25. A flashlight as defined in claim 21 wherein the switch assembly further includes a switch contact wiper, the switch contact wiper comprising at least one resilient metal strip secured to the switch plunger and extending outwardly into biased electrical contact with the switch housing, the switch contact wiper providing a conductive path from the switch plunger to the switch housing and providing frictional resistance against rotation of the switch plunger in the switch housing, and wherein the switch housing is electrically connected to the bulb base terminal.

26. A flashlight as defined in claim 21 wherein the switch assembly further includes a switch driver sleeve, the switch driver sleeve being mounted for rotation about the switch housing and the cap being mounted on the switch driver sleeve for rotation therewith, the switch driver sleeve engaging the switch plunger for imparting rotational movement of the cap to the switch plunger without imparting axial movement of the switch plunger to the switch driver sleeve and cap.

27. A flashlight as defined in claim 26 wherein the switch driver sleeve includes at least two radially inwardly depending tabs received in an annular groove about the switch housing, thereby mounting the switch driver sleeve and cap for rotational movement with respect to the tubular body.

28. A flashlight as defined in claim 26 wherein the switch plunger has a polygonal head and the switch driver sleeve includes panels engaging at least two faces of the polygonal head to impart rotational movement of the switch driver sleeve to the switch plunger while accommodating axial movement of the switch plunger head along the panels.

29. A flashlight as defined in claim 28 wherein the polygonal head of the switch plunger engages the rear of the switch housing to limit forward motion of the switch plunger an increment beyond contact with the rear battery terminal.

30. A flashlight as defined in claim 29 wherein the polyganol head of the switch plunger interferes with the cap to limit rearward movement of the switch plunger.

31. A flashlight as defined in claim 30 wherein the cap has a finial at its rearward end, the finial including a skirt extending into the interior of the cap to mount the finial thereto, and the polygonal head of the switch plunger interferes with the finial skirt to limit rearward movement of the switch plunger.

32. A flashlight as defined in claim 30 wherein the cap rotates less than 360° between the stop positions of the switch plunger.

* * * * *